US005553348A

United States Patent [19]

Brandenburger

[11] Patent Number: 5,553,348

[45] Date of Patent: Sep. 10, 1996

[54] DRYWALL TEXTURING MATERIAL STORAGE DEVICE

[76] Inventor: Thomas J. Brandenburger, 221 N. Park St., Genoa, Nebr. 68640

[21] Appl. No.: 492,186

[22] Filed: Jun. 19, 1995

[51] Int. Cl.[6] ..... B44D 3/12

[52] U.S. Cl. ..... 15/257.06; 220/570; 220/669

[58] Field of Search ..... 15/257.06, 257.05; 220/570, 636, 669, 697

[56] References Cited

U.S. PATENT DOCUMENTS

| | | | |
|---|---|---|---|
| 2,661,858 | 12/1953 | Howell | 15/257.06 |
| 2,669,736 | 2/1954 | Wabnitz | 15/257.06 |
| 2,759,620 | 8/1956 | Pharris | 15/257.06 |
| 3,850,298 | 11/1974 | Jolly | 15/257.06 X |
| 5,461,752 | 10/1995 | Lemon et al. | 15/257.06 |

FOREIGN PATENT DOCUMENTS

| | | | |
|---|---|---|---|
| 2500038 | 7/1976 | Germany | 15/257.06 |

*Primary Examiner*—Chris K. Moore

[57] ABSTRACT

A storage apparatus for holding a volume of drywall texturing material for use with a wallboard texturing applicator is disclosed. The apparatus comprises a pan having paired, straight upstanding longitudinal walls and paired, arcuate upstanding transverse walls. A floor is provided therebetween for forming a reservoir for holding the volume of the drywall texturing material. A plurality of channels is attached to an underside of the pan for urging easy movement of the apparatus as the texturing material is withdrawn from the reservoir.

7 Claims, 4 Drawing Sheets

FIG 5
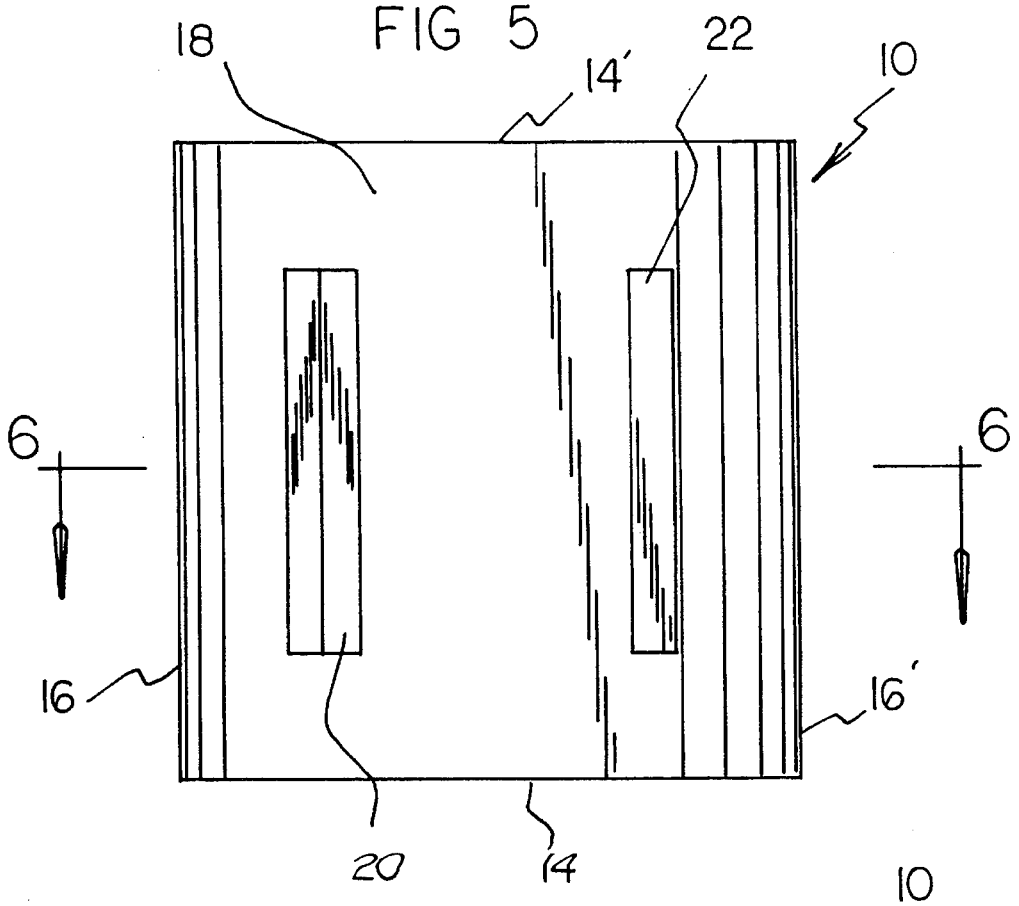
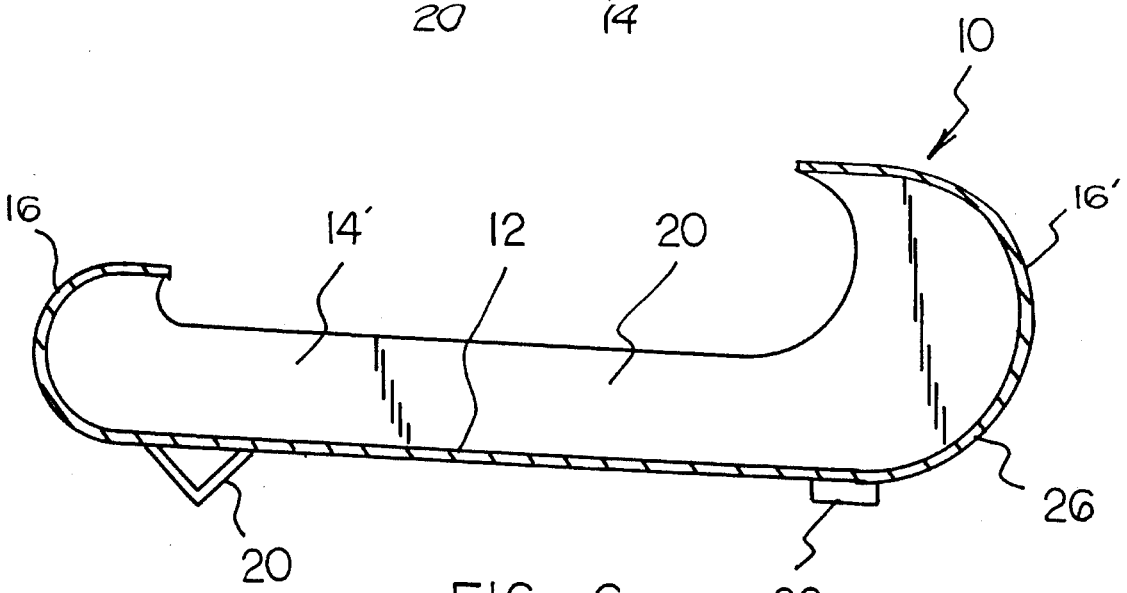
FIG 6

DRYWALL TEXTURING MATERIAL STORAGE DEVICE

BACKGROUND OF THE INVENTION

1. Field of the Invention

The present invention relates to a new and improved drywall texturing material storage device and, more particularly, pertains to a method of storing drywall texturing material for ease of movement when applying the drywall texturing material to wallboard.

2. Description of the Prior Art

The use of heavy, bulky drywall texturing material containers is known in the prior art. More specifically, heavy, bulky drywall texturing material containers heretofore devised and utilized weighing many pounds and being bulky to move when applying drywall texturing material to wallboard, are known to consist basically of familiar, expected, and obvious structural configurations, notwithstanding the myriad of designs encompassed by the crowded prior art which has been developed for the fulfillment of countless objectives and requirements.

The prior art discloses a large number of heavy, bulky drywall texturing material containers. By way of example, U.S. Pat. No. 4,928,843 issued to Gunderson discloses a paint can and roller pan device for storing a volume of paint and serving as a roller pan.

U.S. Pat. No. 4,010,866 issued to McClane discloses a paint roller pan having two separate paint reservoirs and an upper section having a ribbed base for removing excess paint.

U.S. Pat. No. Des. 278,512 issued to Lojko appears to disclose a holder for spackle material.

U.S. Pat. No. Des. 327,755 issued to Boyer appears to disclose a paint roller tray having a cover therefor for storing brushes and paint tool accessories therein.

U.S. Pat. No. Des. 286,458 issued to Pages appears to disclose a paint tray having a corrugated roller base longitudinally oriented within the paint tray.

In this respect, the drywall texturing material storage device according to the present invention substantially departs from the conventional concepts and designs of the prior art, and in doing so provides an apparatus primarily developed for the purpose of a method of storing drywall texturing material for ease of movement when applying the drywall texturing material to wallboard.

It is therefore an object of the present invention to provide a new and improved drywall texturing material storage device which has all the advantages of the prior art drywall texturing material containers and none of the disadvantages.

It is another object of the present invention to provide a new and improved drywall texturing material storage device which may be easily and efficiently manufactured and marketed.

It is a further object of the present invention to provide a new and improved drywall texturing material storage device which is of a durable and reliable construction.

An even further object of the present invention is to provide a new and improved drywall texturing material storage device which is susceptible of a low cost of manufacture with regard to both materials and labor, and which accordingly is then susceptible of low prices of sale to the consuming public, thereby making such a drywall texturing material storage device economically available to the buying public.

Still yet another object of the present invention is to provide a new and improved drywall texturing material storage device which provides in the apparatuses and methods of the prior art some of the advantages thereof, while simultaneously overcoming some of the disadvantages normally associated therewith.

Even still another object of the present invention is to provide a method of storing drywall texturing material for ease of movement when applying the drywall texturing material to wallboard.

Lastly, it is an object of the present invention to provide a storage apparatus for holding a volume of drywall texturing material for use with a wallboard texturing applicator comprising a pan having paired, straight upstanding longitudinal walls and paired, arcuate upstanding transverse walls. A floor is provided therebetween for forming a reservoir for holding the volume of the drywall texturing material. A plurality of channels is attached to an underside of the pan for urging easy movement of the apparatus as the texturing material is withdrawn from the reservoir.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Therefore, it can be appreciated that there exists a continuing need for a new and improved drywall texturing material storage device which can be used for a method of storing drywall texturing material for ease of movement when applying the drywall texturing material to wallboard. In this regard, the present invention substantially fulfills this need.

SUMMARY OF THE INVENTION

In view of the foregoing disadvantages inherent in the known types of heavy, bulky drywall texturing material containers now present in the prior art, the present invention provides a new and improved drywall texturing material storage device. As such, the general purpose of the present invention, which will be described subsequently in greater detail, is to provide a new and improved drywall texturing material storage device which has all the advantages of the prior art and none of the disadvantages.

To attain this, the present invention essentially comprises a storage apparatus for holding a volume of drywall texturing material for use with a wallboard texturing cylindrical applicator. The invention comprises a pan having paired, straight upstanding longitudinal walls and paired, arcuate upstanding transverse front and rear walls, the rear wall having a radius of curvature essentially equal to that of applicator with the front wall having a radius of curvature essentially twice that of the rear wall and a floor therebetween for forming a reservoir for holding the volume of the drywall texturing material. A plurality of channels are attached to an underside of the pan for urging easy movement of the apparatus as the texturing material is withdrawn from the reservoir. The channels are in a transverse relationship with the pan and further have unequal heights for biasing the pan towards a front section.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 shows the support base having an unequal height for tilting the invention forwardly.

FIG. 5 is a bottom plan view of the invention showing a plurality of channels oriented on an underside of the base of the invention.

FIG. 6 is a horizontal cross-sectional view of the invention taken along viewing lines 4—4 of FIG. 3.

The same reference numerals refer to the same parts throughout the various Figures.

DESCRIPTION OF THE PREFERRED EMBODIMENT

Figure 1:
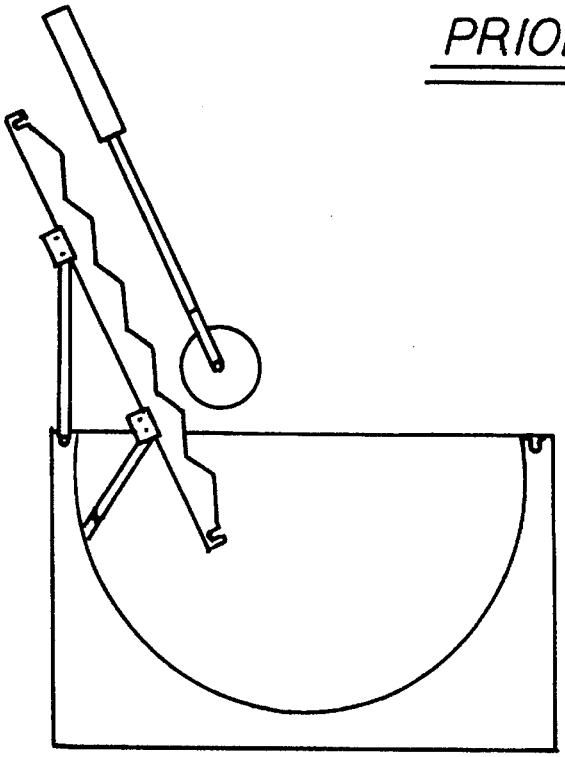
FIG 1 PRIOR ART
FIG. 1 is a side elevation view of a device constructed in accordance with the prior art disclosure.
Figure 2:
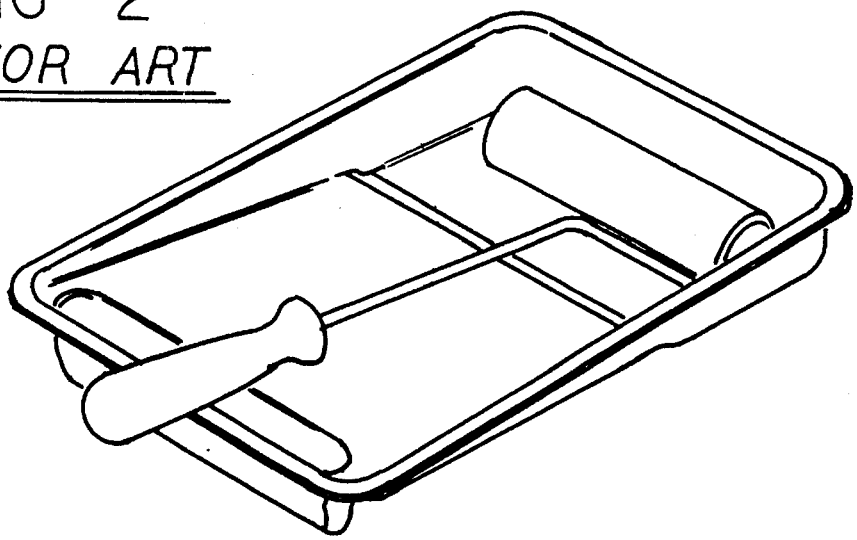
FIG 2 PRIOR ART
FIG. 2 is a perspective illustration of a device constructed in accordance with the prior art disclosure.
Figure 3:
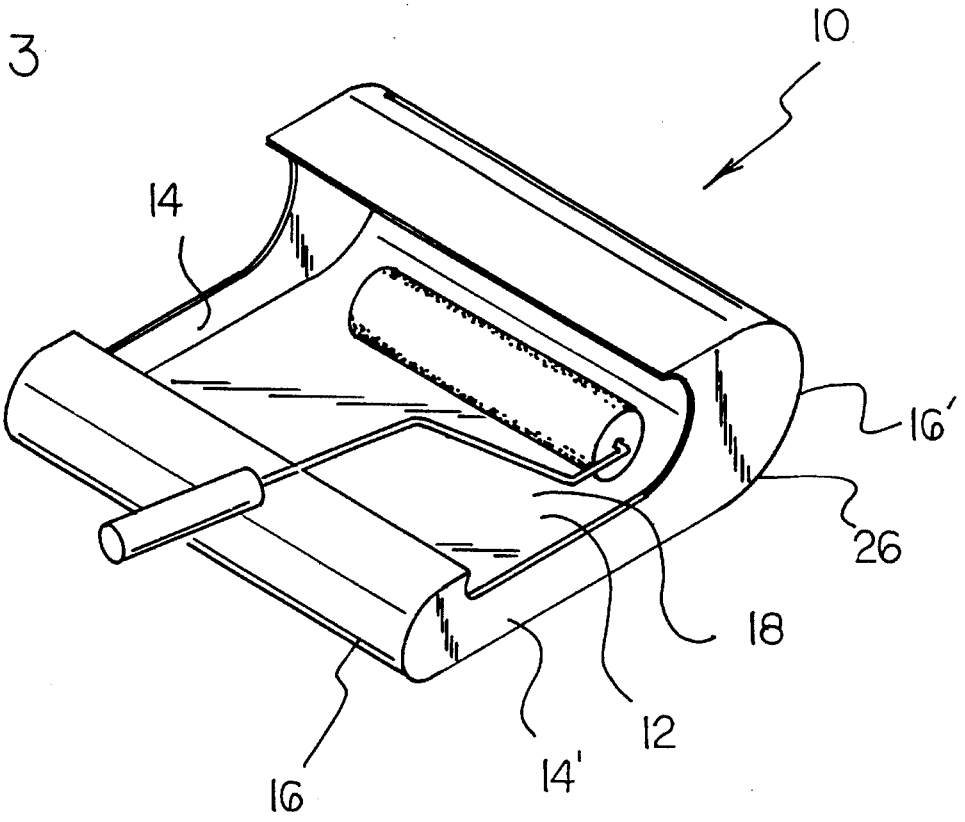
FIG. 3 is a perspective illustration of the preferred embodiment of the drywall texturing material storage device constructed in accordance with the principles of the present invention.
Figure 4:
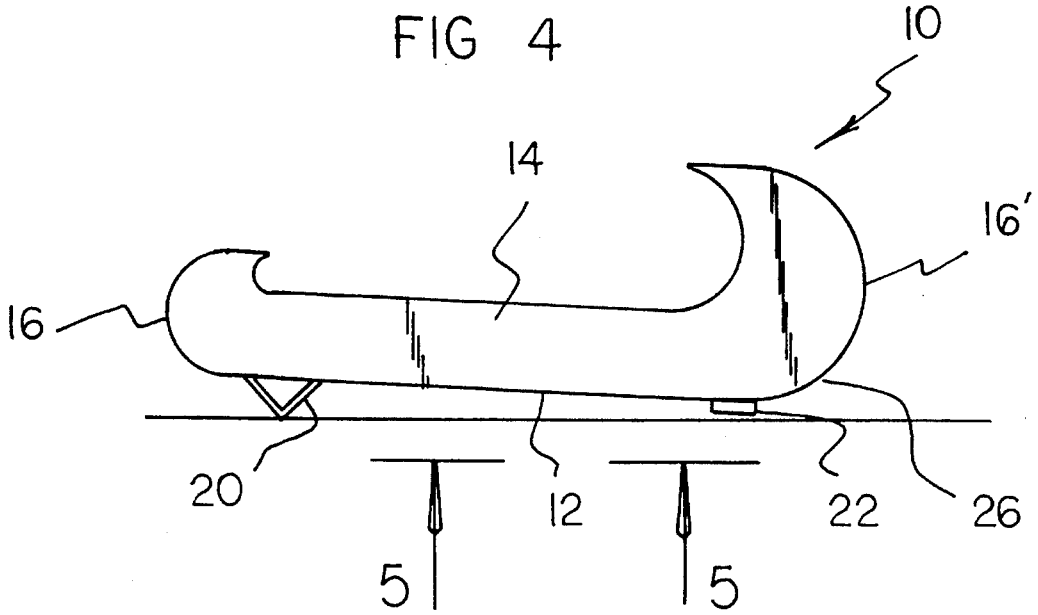
FIG. 4 is a right hand elevation view of the invention as disclosed in FIG. 3.
Figure 7:
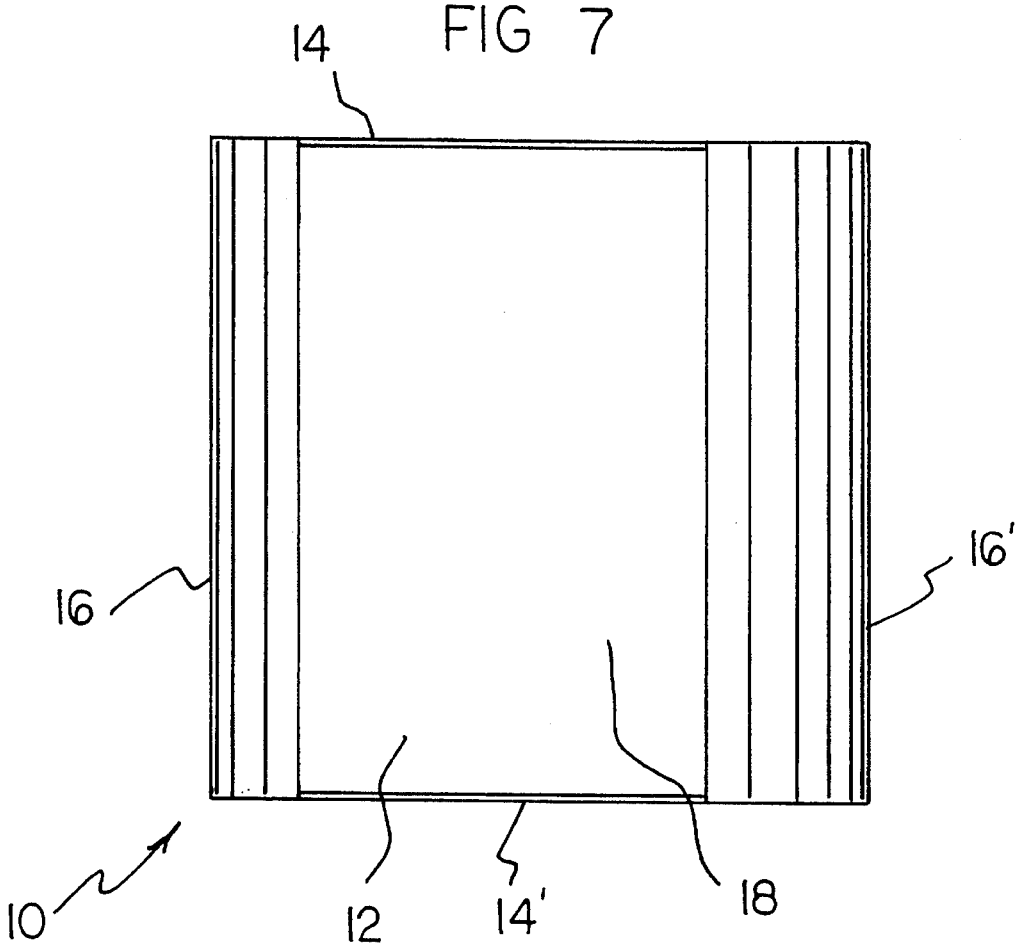
FIG. 7 is a top plan view of the invention as disclosed in FIG. 3.
Figure 8:
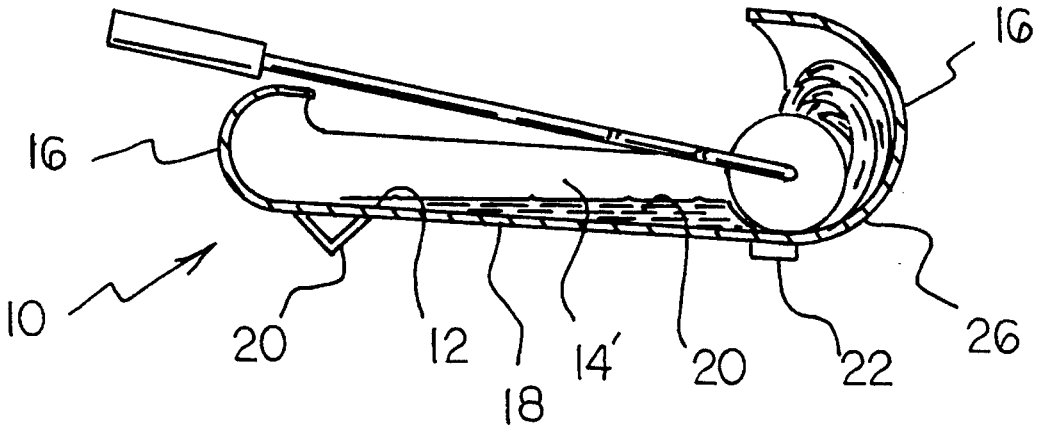
FIG. 8 is a fragmentary cross-sectional view of the invention disclosing the use and operation of the invention in a cooperative relationship with a conventional texturing applicator for storing drywall texturing material on the applicator.

With reference now to the drawings, and in particular to FIGS. 1 through 8 thereof, the preferred embodiment of the new and improved drywall texturing material storage apparatus embodying the principles and concepts of the present invention and generally designated by the reference numeral 10 will be described.

The present invention, the new and improved drywall texturing material storage device, is a system comprised of a plurality of components. The components in their broadest context include a pan and a plurality of channels. Each of the individual components is specifically configured and correlated one with respect to the other to attain the desired objectives. The drywall texturing pan is a drywall accessory tool designed to hold the drywall texturing material when applying the texturing material to ceilings and walls. The invention will result in a significant reduction in the labor cost associated with applying texturing materials to a ceiling or a wall. This is due to the fact that the texturing mechanic will not have to handle the containers that the material usually is shipped in. Heretofore, there was no device specifically designed to reduce the labor associated with applying texture material. The only alternative was to use the conventional paint pan which is not designed to handle a material with the consistency of texturing material.

The application of drywall texturing material on seams is well known in the art. The advent of texturing wallboard and ceilings with drywall texturing material is very new and very desirable in modern construction. This is accomplished by covering the entire surface area of the exposed wallboard and ceilings with the drywall texturing material and using a special type of applicator to develop the depth or textured look. The storage of large amounts of drywall texturing material for application on wallboard has typically used a wheelbarrow or washtub to hold the large quantities required. For example, a five gallon pail of texturing material weighs over three hundred pounds. Typically in the field, the five gallon container is emptied into a washtub and moved along as the mechanic applies the texturing material to the entire exposed surface of the wallboard. This invention will dramatically reduce the amount of time required to move the washtub from location to location when it is full of texture material. Further, the invention will allow the mechanic to load up the texturing applicator with texture material in a shorter time and also will reduce the spillage of texture material due to the arcuate ends which maintain the applicator with the desired amount of texture material.

Referring generally to FIG. 1, the invention 10 comprises a pan 12 having paired, straight upstanding longitudinal walls 14, 14' and paired, arcuate upstanding transverse walls 16, 16'. A floor 18 is disposed therebetween and forms a reservoir for holding the volume of the drywall texturing material. A plurality of channels 22, 22' are attached to an underside 24 of the pan 12. The channels 20, 22 are disposed in a transverse relationship with the pan 12.

The invention 10 is fabricated from a sheet metal or plastic, preferably plastic. The texturing material pan 12 is approximately 24" long and has a 12" opening between the two ends 16, 16'. One end 16' has a depth of 8" at the forward section 26 and the other end 16 has a depth of 4". In this manner, the texturing material will gravitate towards the deeper forward position. The texturing material pan 12 is wide enough to accommodate a conventional texturing applicator up to 24" in width. Also, the texturing material pan 12 can hold up to five gallons of the texturing material. A less preferred embodiment of the device could also be made with wheels or rollers for commercial applications where the drywallers have extremely large areas of wallboard to apply the texture material to.

In use and operation, the sheetrock texturing compound or "texturing material" is poured into the pan 12. Then the texturing roller is pushed back and forth in the material in the pan 12 until it is completely covered. Thereupon, the sheetrocker removes the texturing roller from the pan 12 and applies the material in a conventional manner to texture the walls and ceilings. The curved ends 16, 16' of the pan 12 enable any excess texturing material to fall back into the pan 12 from the roller and maintain uniform coverage of the applicator as the applicator is being rolled through the texturing material. When the texturing material runs low in the pan 12, the arcuate ends 16, 16' also allow for applying the last portion of the texturing material onto the texturing applicator.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved storage apparatus for holding a volume of drywall texturing material for use with a wallboard texturing cylindrical applicator comprising, in combination:

a pan having paired, straight upstanding longitudinal walls and paired, arcuate upstanding transverse front and rear walls, the rear wall having a radius of curvature essentially equal to that of said applicator with the front wall having a radius of curvature essentially twice that of the rear wall and a floor therebetween for forming a reservoir for holding the volume of the drywall texturing material; and a plurality of channels attached to an underside of the pan, the channels being in a transverse relationship with the pan.

2. A storage apparatus for holding a volume of drywall texturing material comprising a pan having paired, straight upstanding longitudinal walls and paired, arcuate upstanding transverse walls and a floor therebetween for forming a reservoir, and a plurality of channels attached to an underside of the pan.

3. A storage apparatus as recited in claim 2 wherein the pan is adapted for holding about five gallons of the drywall texturing material.

4. A storage apparatus as recited in claim 2 wherein the channels are in a transverse relationship with the pan.

5. A storage apparatus as recited in claim 2 wherein the channels further include unequal heights.

6. A storage apparatus as recited in claim 2 wherein the apparatus is fabricated from a metallic material.

7. A storage apparatus as recited in claim 2 wherein the apparatus is fabricated from an elastomeric material.

* * * * *